US007746622B2

(12) United States Patent
Young

(10) Patent No.: US 7,746,622 B2
(45) Date of Patent: Jun. 29, 2010

(54) STUN GUN WITH AN EXTENDABLE ELECTRIC SHOCK DISTANCE

(76) Inventor: Min-Li Wang Young, 1F., No. 41, Alley 2, Bade Rd., Yingge Chen, Taipei Hsien (TW)

( * ) Notice: Subject to any disclaimer, the term of this patent is extended or adjusted under 35 U.S.C. 154(b) by 330 days.

(21) Appl. No.: 11/907,934

(22) Filed: Oct. 18, 2007

(65) Prior Publication Data

US 2009/0103231 A1 Apr. 23, 2009

(51) Int. Cl.
*H01T 23/00* (2006.01)

(52) U.S. Cl. ..... 361/232

(58) Field of Classification Search ..... 361/232
See application file for complete search history.

(56) References Cited

U.S. PATENT DOCUMENTS 4,846,044 A * 7/1989 Lahr ..... 89/1.11
5,103,366 A * 4/1992 Battochi ..... 361/232
5,225,623 A * 7/1993 Krasnow ..... 89/1.1

* cited by examiner

*Primary Examiner*—Stephen W Jackson
(74) *Attorney, Agent, or Firm*—Muncy, Geissler, Olds & Lowe, PLLC

(57) ABSTRACT

A stun gun with an extendable electric shock distance has a high voltage electric arc generator and a conductive liquid supplier. The high voltage electric arc generator generates a high voltage electric arc. A conductive liquid fills with inside the conductive liquid supplier. When the conductive liquid is spurted from the conductive liquid supplier, the conductive liquid is passing through the high voltage electric arc. Since the conductive liquid has conductance, the conductive liquid spurted from the stun gun is able to extend an electric shock distance.

11 Claims, 5 Drawing Sheets

STUN GUN WITH AN EXTENDABLE ELECTRIC SHOCK DISTANCE

BACKGROUND OF THE INVENTION

1. Field of the Invention

The invention relates in general to a stun gun, and more particularly to a stun gun that can extend an electric shock distance.

2. Description of the Related Art

In view of public security concern, more and more people bring a stun gun to protect them from harm. A conventional stun gun has two electrodes at one end of the stun gun. A transformer and a battery are configured inside the stun gun. A distance between the two electrodes is very small. The transformer is used to raise an output voltage of the battery to output to one of the electrodes. Since the distance between two electrodes is very short, a high-voltage electric arc is generated between the two electrodes. With the high-voltage electric arc to direct contact a human body, the electric shock effect can be achieved.

However, the above-mentioned stun gun can only provide the electric shock effect by closing to touch a person.

In order to improve this disadvantage, another stun gun is available in the market that can extend the electric shock distance. A main design of the stun gun is to configure a steel wire between the two electrodes. When the stun gun is conductive, the steel wire is also conductive. A user can extend the electric shock distance by waving the steel wire. Nevertheless, a waving direction of the steel wire is not easy to control and even may harm oneself if the steel wire touches self's body.

SUMMARY OF THE INVENTION

An objective of the present invention is to provide a stun gun that has an long electric shock distance by spouting out electrified conductive liquid.

In order to achieve the above objective, the stun gun in accordance with the present invention has an electric shock distance has a high voltage electric arc generator and a conductive liquid supplier. The high voltage electric arc generator generates a high voltage electric arc. A conductive liquid fills with inside the conductive liquid supplier. When the conductive liquid is spurted from the conductive liquid supplier, the conductive liquid is passing through the high voltage electric arc. Since the conductive liquid has conductance, the conductive liquid spurted from the stun gun is able to extend an electric shock distance.

DETAILED DESCRIPTION OF THE INVENTION

Figure 1:
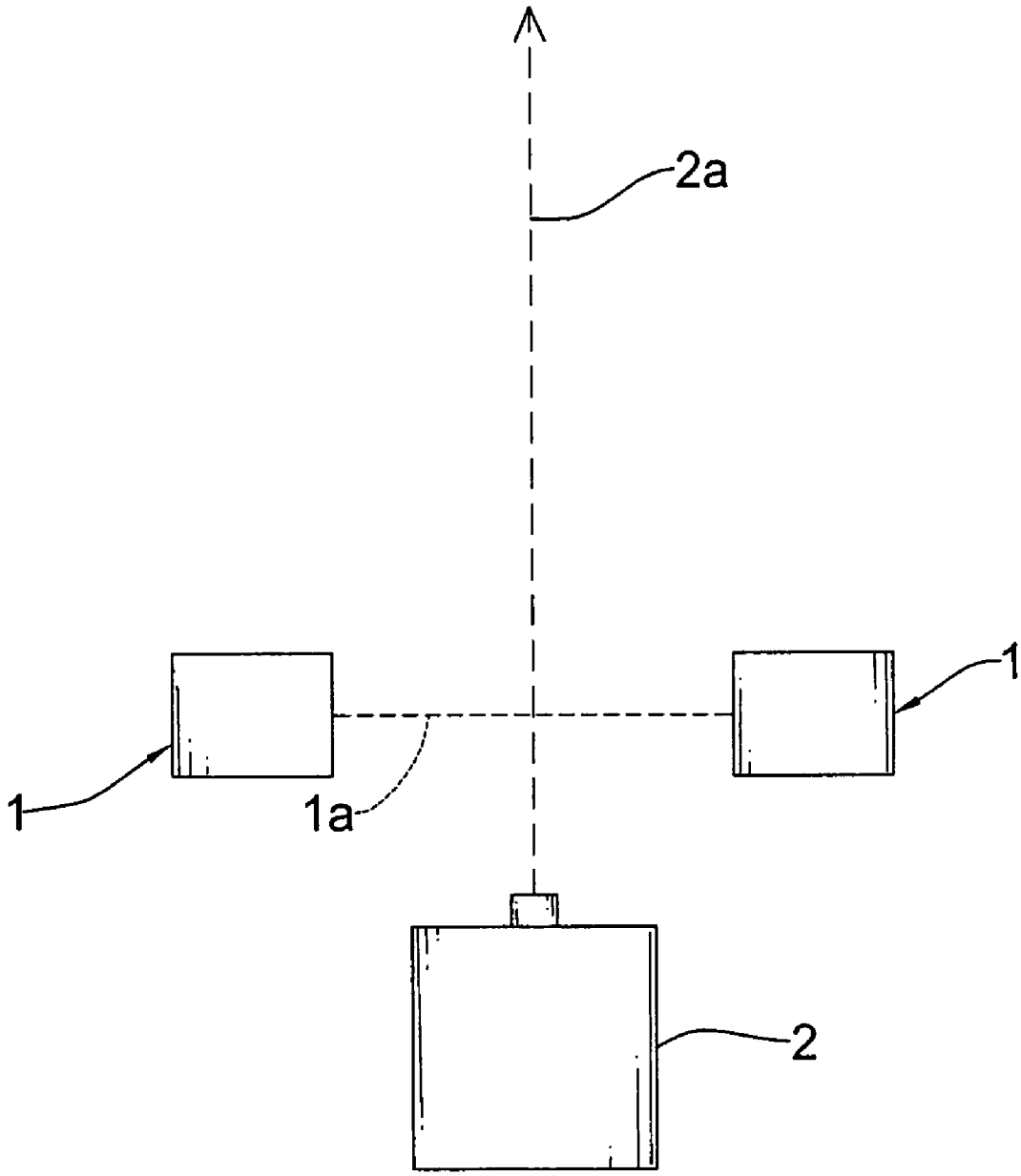
FIG. 1 is a block diagram of a stun gun in accordance with the present invention.

With reference to FIG. 1 the stun gun in accordance with the present invention has a high voltage electric arc generator 1 and a conductive liquid supplier 2. The high voltage electric arc generator 1 generates a high voltage electric arc 1*a*. A conductive liquid fills with inside the conductive liquid supplier 2. When the conductive liquid is spurted from the conductive liquid supplier 2, the conductive liquid 2*a* is passing through the high voltage electric arc 1*a*. Since the conductive liquid has conductance, the conductive liquid 2*a* spurted from the stun gun is able to extend an electric shock distance.

Figure 2:
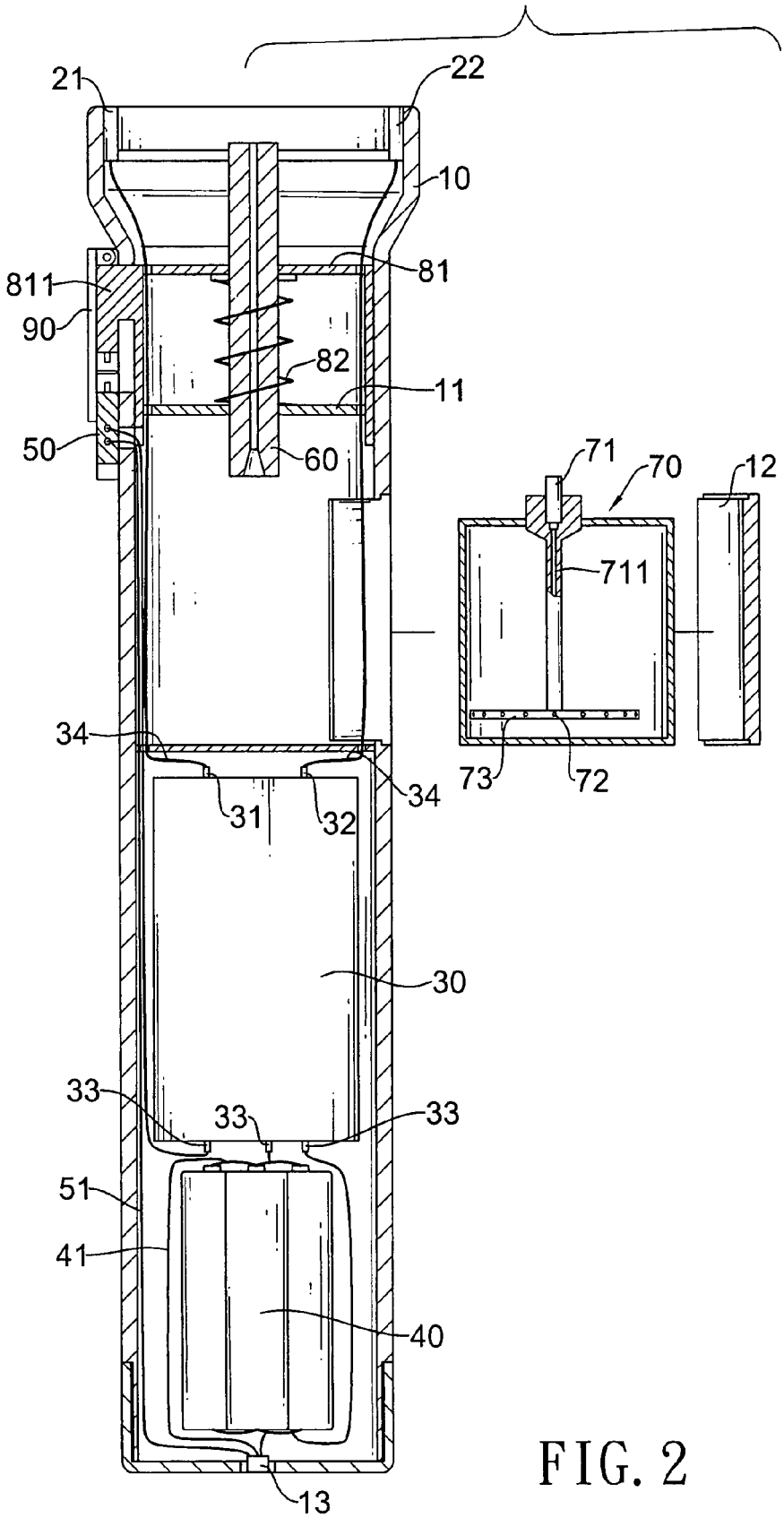
FIG. 2 is a cross sectional and exploded view in partial of a stun gun in accordance with the present invention.
Figure 3:
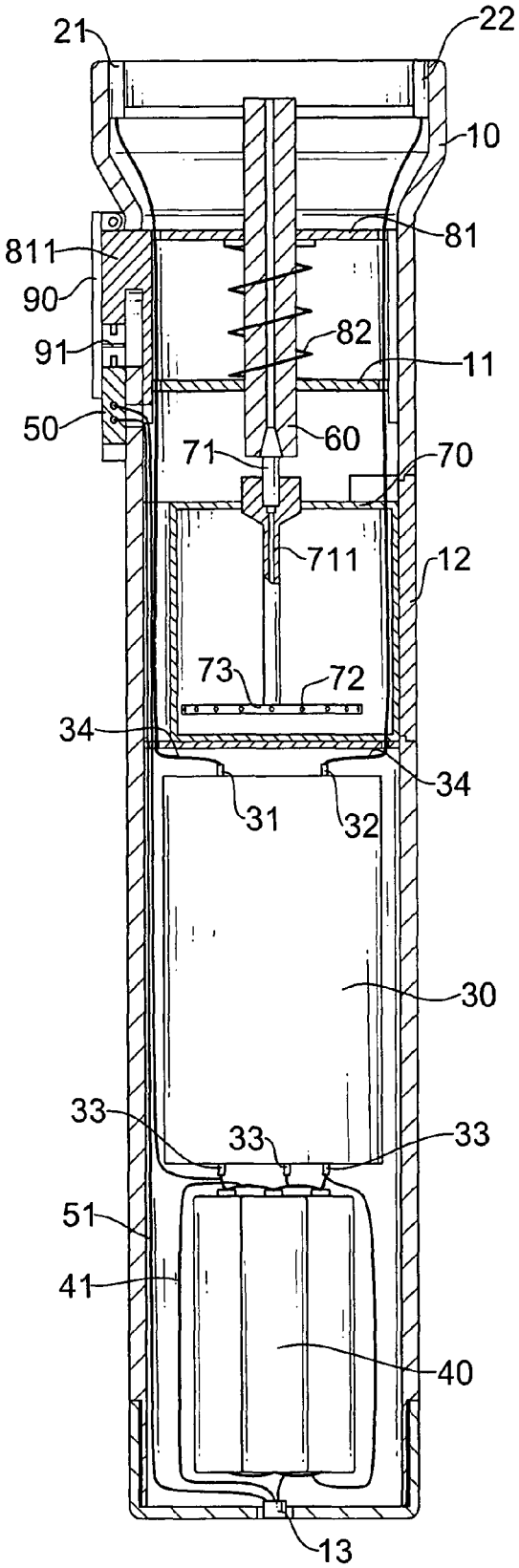
FIG. 3 is a cross sectional view of the stun gun in accordance with the present invention.

With further reference to FIGS. 2 and 3, the voltage electric arc generator 1 has a housing 10, a first electrode 21, a second electrode 22, a voltage booster 30, a recharge terminal 13, a battery set 40 and a trigger switch 50.

The hosing 10 is of a cannular form having a partition 11. The partition 11 is fixed inside an inner wall of the housing 10. An opening is formed on a side of the housing 10. A separatable lid part 12 is located at the opening of the housing 10. The housing 10 has a front end and a rear end. The front end has two opposite areas.

The first electrode 21 and the second electrode 22 are respectively mounted inside the two opposite areas of a front end of the housing 10. The recharge terminal 13 is mounted on the rear end of the housing 10.

The voltage booster 30 is mounted inside the housing 10 having a positive output terminal 31, a negative output terminal 32 and a set of input terminals 33. The positive output terminal 31 and the negative output terminal 32 are respectively coupled to the first electrode 21 and the second electrode 22 via a first electric wire 34.

The battery set 40 is mounted inside the housing 10. The battery set 40 is coupled to the input terminals 33 of the voltage booster 30 through a second electric wire 41. In this way, a direct current (DC) voltage can provide to the voltage booster 30. Then the voltage booster 30 raises the DC voltage to a high voltage to output to the first electrode 21. Since a distance between the first electrode 21 and the second electrode 22 is very small, the high-voltage electric arc is inducted to generate between the first electrode 21 and the second electrode 22; so as to make the voltage return to the voltage booster 30 from the second electrode 22. In this preferred embodiment, the battery set 40 is a rechargeable battery set and is coupled to the recharge terminal 13 on the rear end of the housing 10, so as to acquire mains electricity via a transformer plug (not shown in the diagram) to recharge.

The trigger switch 50 is mounted outside the housing 10 and connected to the input terminals 33 of the voltage booster 30 and the battery set 40 in serial through a third electric wire 51. When the trigger switch 50 turn on, the battery set provides voltage to the voltage booster 30. The first and second electrodes 21, 22 are obtained the high voltage.

The conductive liquid supplier 2 has a spray tube 60, a pressure container 70, a switch part and a secure lid 90.

The spray tube 60 is mounted through the partition of the housing 10 and has a first end and a second end. The first end the spray tube 60 is located between the first and second electrodes 21, 22.

The pressure container 70 is mounted inside the housing 10 corresponding to the opening of the housing 10. The pressure container 70 can be taken out after the separatable lid part 12 is removed from the housing 10 as shown in FIG. 1. The pressure container 70 is filled with the conductive liquid therein. Moreover, the pressure container 70 has a spray nozzle 71, a pipe 711, a disk 73. The spray nozzle 71 is connected and against to the second end of the spray tube 60 and also connected to an end of the pipe 711 inside the pressure container 70. The other end of the pipe 711 is connected to the disk 73. The disk 73 is close to bottom of the pressure container 70. Multiple apertures 74 are formed at a side peripheral of the disk 73 and communicated with the pipe 711. Therefore, the pipe 711 can easily pumps the conductive liquid in bottom of the apertures 74.

When the spray nozzle 71 is pressed, a pressure inside the pressure container 70 is changed, then the conductive liquid is absorbed from the apertures 72 of the disk 73 through the pipe 711, the spray nozzle 71, the spray tube 60 and finally to spout out of the stun gun and through the electric arc.

Figure 4:
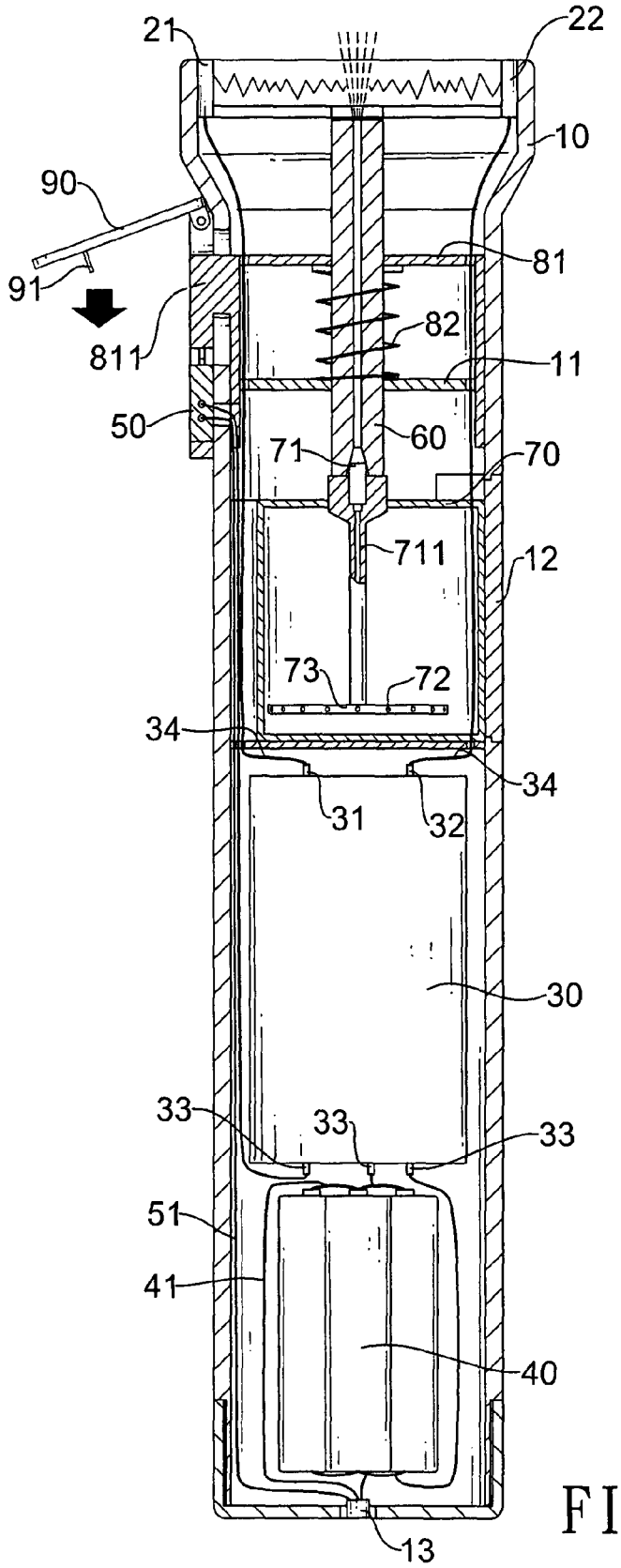
FIG. 4 is an operational view of the stun gun that spurts conductive fluid through the high voltage electric arc.

The switch part is configured on the housing 10 and goes through the housing 10 to be connected to the spray tube 60. The switch part can be pushed to slide on the housing 10 to drive the spray tube 60 to move inside the housing 10. A sliding path of the switch part on the housing 10 goes to be connected to the trigger switch 50. With reference to FIG. 4, when the switch part is pushed, the trigger switch 50 turns on, so as to make the voltage booster 30 output a high voltage to the first and second electrodes 21, 22 to generate the electric arc. At the time, the spray tube 60 is driven to push the pray nozzle 71 of the pressure container 70. In this way, the conductive liquid spouts out of the pressure container 70 and passes through the electric arc. In this preferred embodiment, the switch part has a sliding part 81, a push part 811 and an elastic element 82.

The sliding part 81 is configured inside the housing 10 located between the first electrode 21 and the second electrode 22 and the partition 11. The sliding part 81 clips the spray tube 60.

The push part 811 is located on the housing 10 against the trigger switch 50. With reference to FIG. 3, when the push part 811 is pushed, the push part 811 presses the trigger switch 50, so as to make the first electrode 21 conductive and also to drive the spray tube 60 to push the pray nozzle 71 of the pressure container 70. Hence the conductive liquid spouts out of the stun gun from the pressure container 70 through the spray tube 60.

Figure 5:
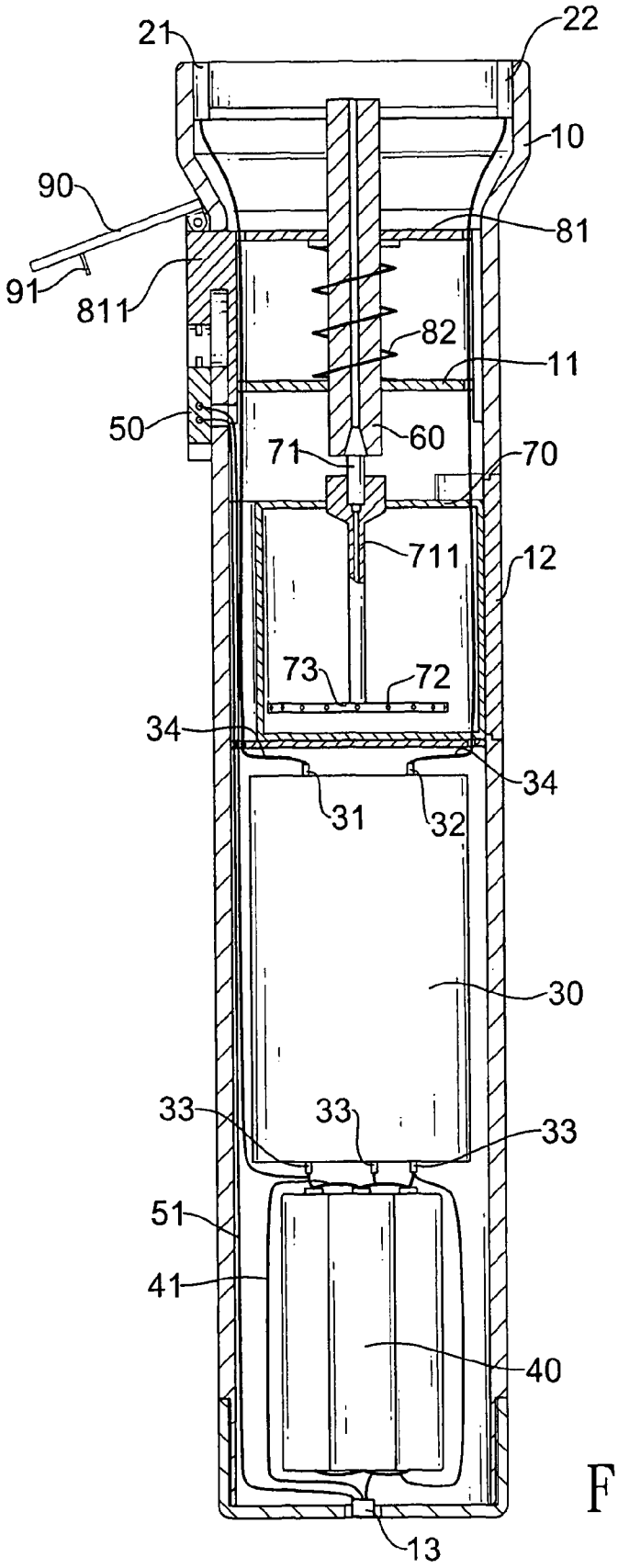
FIG. 5 is another operational view of the stun gun in accordance with the present invention wherein a recovery force of an elastic element make a sliding part return to an original position.

The elastic element 82 is mounted on the spray tube 60 between the partition 11 and the sliding part 81. With reference to FIG. 4, when the push part 811 is pushed to drive the sliding part 81 moving toward the partition 11, the elastic element 82 is compressed, so as to generate an opposite recovery force. With reference to FIG. 5, when the push part 811 is released, the sliding part 81 returns to an original position with the recovery force of the elastic element 82 and then the pressure container 70 stops spurting the conductive liquid.

The secure lid 90 is pivoted on the housing 10 to cover the push part 811. With reference to FIG. 3, when the secure lid 90 covers the push part 811, the push part 811 can not be pushed. Hence the secure lid 90 can avoid the push part 811 being pushed when the stun gun is not used. On the other hand, with reference to FIG. 4, when the secure lid 90 is lifted, the push part 811 can be pushed to operate the stun gun.

Therefore, it can be understood from the above description that the stun gun with an extendable electric shock distance makes good use of the switch part to enable the operation of the stun gun and also to make the conductive fluid spout out of the pressure container. The spouted conductive fluid is electrified by going through the high-voltage electric arc. Hence the electrified conductive fluid can provide an electric shock effect by contacting a human body and also can achieve the objective to extend the electric shock distance.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A stun gun with an extendable electric shock distance comprising:

a high voltage electric arc generator generating a high voltage electric arc and having:

a housing having a front end and a rear end;

a first electrode and a second electrode mounted in the front end of the housing;

a voltage booster mounted inside the housing and electrically coupled to the first electrode and the second electrode;

a battery set mounted inside the housing electrically coupled to the voltage booster;

a trigger switch mounted on the housing and electrically coupled between the voltage booster and the first electrode;

a spray tube configured inside the housing and having a first end and a second end, wherein the first end is located between the first electrode and the second electrode;

a pressure container mounted inside the housing, filled with conductive liquid and comprising a spray nozzle connected and against to the second end of the spray tube; and a switch part configured on the housing and passing through the housing to be connected to the spray tube, wherein the switch part is pushed to slide on the housing to drive the spray tube to move inside the housing, wherein a sliding path of the switch part on the housing goes to be connected to the trigger switch; and a conductive liquid supplier filled with a conductive liquid, wherein the conductive liquid is spurted from the conductive liquid supplier and then the liquid is passing through the high voltage electric arc of the high voltage electric arc generator.

2. The stun gun with an extendable electric shock distance as claimed in claim 1, wherein the switch part comprises:

a sliding part configured inside the housing and clipping the spray tube; and a push part connected to the sliding part and located on the housing against the trigger switch.

3. The stun gun with an extendable electric shock distance as claimed in claim 1 further comprising:

a partition fixed inside an inner wall of the housing and located between the sliding part and the pressure container, wherein the spray tube passes through the partition; and an elastic element mounted outside the spray tube and being between the partition and the sliding part.

4. The stun gun with an extendable electric shock distance as claimed in claim 3 further comprising a secure lid, wherein the secure lid is pivoted on the housing to cover the switch part and the trigger switch.

5. The stun gun with an extendable electric shock distance as claimed in claim 1, wherein the pressure container further comprises:

a pipe mounted inside the pressure container and having two ends, wherein one end is connected to the spray nozzle; and a disk mounted inside the pressure container and having multiple apertures, each of which is communicated with the pipe.

6. The stun gun with an extendable electric shock distance as claimed in claim 2, wherein the pressure container further comprises:

a pipe mounted inside the pressure container and having two ends, wherein one end is connected to the spray nozzle; and a disk mounted inside the pressure container and having multiple apertures, each of which is communicated with the pipe.

7. The stun gun with an extendable electric shock distance as claimed in claim 3, wherein the pressure container further comprises:

a pipe mounted inside the pressure container and having two ends, wherein one end is connected to the spray nozzle; and a disk mounted inside the pressure container and having multiple apertures, each of which is communicated with the pipe.

8. The stun gun with an extendable electric shock distance as claimed in claim 4, wherein the pressure container further comprises:

a pipe mounted inside the pressure container and having two ends, wherein one end is connected to the spray nozzle; and a disk mounted inside the pressure container and having multiple apertures, each of which is communicated with the pipe.

9. The stun gun with an extendable electric shock distance as claimed in claim 4, wherein an opening is formed on a side of the housing corresponding to the pressure container, wherein a separatable lid part is located at the opening.

10. The stun gun with an extendable electric shock distance as claimed in claim 1, wherein the battery set is a rechargeable battery set.

11. The stun gun with an extendable electric shock distance as claimed in claim 1, further comprising a recharge terminal electrically connected to the battery set.

* * * * *